US007654882B2

(12) United States Patent
Berner

(10) Patent No.: US 7,654,882 B2
(45) Date of Patent: Feb. 2, 2010

(54) BRA AND BODY SHAPER GARMENT

(75) Inventor: Staci Lynn Berner, North Potomac, MD (US)

(73) Assignee: Shapeez, LLC., N. Potomac, MD (US)

( * ) Notice: Subject to any disclaimer, the term of this patent is extended or adjusted under 35 U.S.C. 154(b) by 67 days.

(21) Appl. No.: 11/485,733

(22) Filed: Jul. 13, 2006

(65) Prior Publication Data

US 2008/0026675 A1 Jan. 31, 2008

(51) Int. Cl.
*A41C 3/00* (2006.01)

(52) U.S. Cl. ..... 450/2; 450/1

(58) Field of Classification Search ..... 450/1–4, 450/7–11, 19–22, 30, 31

See application file for complete search history.

(56) References Cited

U.S. PATENT DOCUMENTS 1,953,797 A * 4/1934 Daniel ..... 2/67
4,095,291 A * 6/1978 Di Tullio ..... 2/67

OTHER PUBLICATIONS

1993 Sears Spring/Summer Annual Catalog; pp. 188,item E; p.189 and 192,item A.*
Sears Catalog, 1993 Summer/Spring-p. 170, Item A- Moderate Control Underwire Briefer.*

* cited by examiner

*Primary Examiner*—Gloria Hale

(57) ABSTRACT

A woman's garment comprising a tubular garment body having an integrated full support bra at the front portion thereof and a back portion. The back portion has a high cut neckline which the natural curve of the back of the neckline and is contoured around the back arm and underarm areas for evenly compressing and supporting the upper back and lower back and posterior auxiliary fat pads without visible bra lines or bulges on the back and underarm area.

6 Claims, 3 Drawing Sheets

BRA AND BODY SHAPER GARMENT

FIELD OF THE INVENTION

The present invention relates generally to a woman's combination bra and body shaper garment.

BACKGROUND OF THE INVENTION

Different types of bra and garment combinations are known in the art. For example, U.S. Pat. No. 6,530,820 provides an underwire bra garment which has long shoulder straps that extend down the back of the garment which results in the back portion of this garment being inadequate for covering and compressing the most fleshy parts of the back and underarms, such as the posterior auxiliary fat pads of the back and underarms of a woman's body. Similarly, U.S. Pat. No. 4,798,557 provides an underwire bra garment which also has long shoulder straps that extend down the back of the garment and again is inadequate at covering and compressing the posterior auxiliary fat pads. Additionally, other garments with integrated bra supports are known which have an elastic band at the back portion which provides for visible type of bra lines at the back and resulting in unflattering bulges on the back and underarm areas. While other long line garments with an integrated bra offer breast support, such garments offer no compression of the posterior auxiliary fat pads or the upper back, thereby allowing these areas to have unsightly bulges from the back and side views.

SUMMARY OF THE INVENTION

It is an object of the present invention to provide a woman's combination bra and body shaper garment providing a streamlined and seamless figure from the front, side and back views and eliminating visible bra lines and unflattering bulges on the back and underarm areas.

In accordance with the present invention, the garment comprises a form fitting bodice cut generally in the form of a body shaper and made of a wickable stretch fabric with an integrated full support bra for supporting and shaping the breast while having a back neck area which is high cut so as to follow the natural curve of the neckline and contoured around the back arm area and underarm area to encase and compress the posterior auxiliary fat pads.

DETAILED DESCRIPTION OF THE PREFERRED EMBODIMENT

Figure 1:
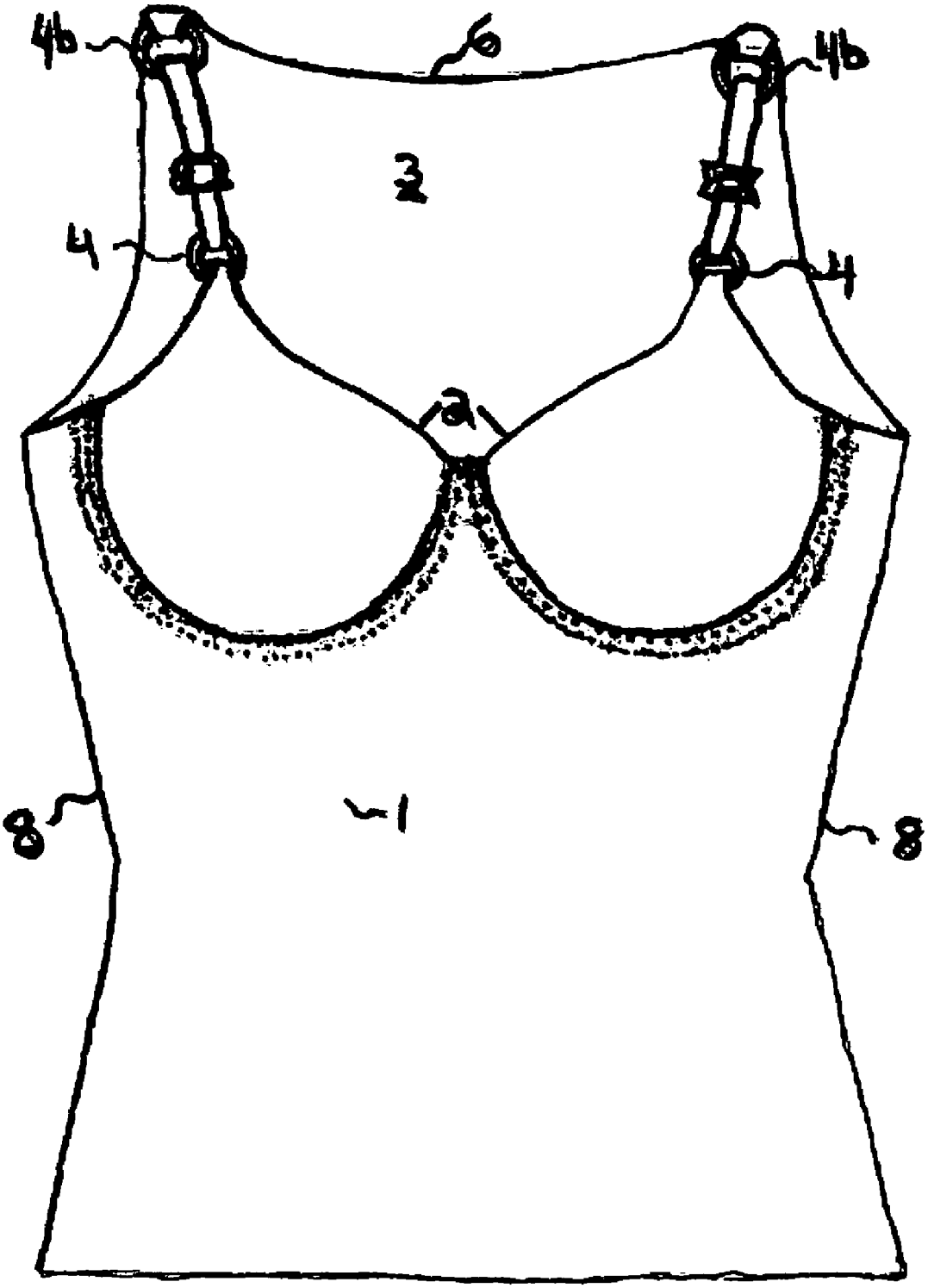
FIG. 1 is a front view of the garment.
Figure 2:
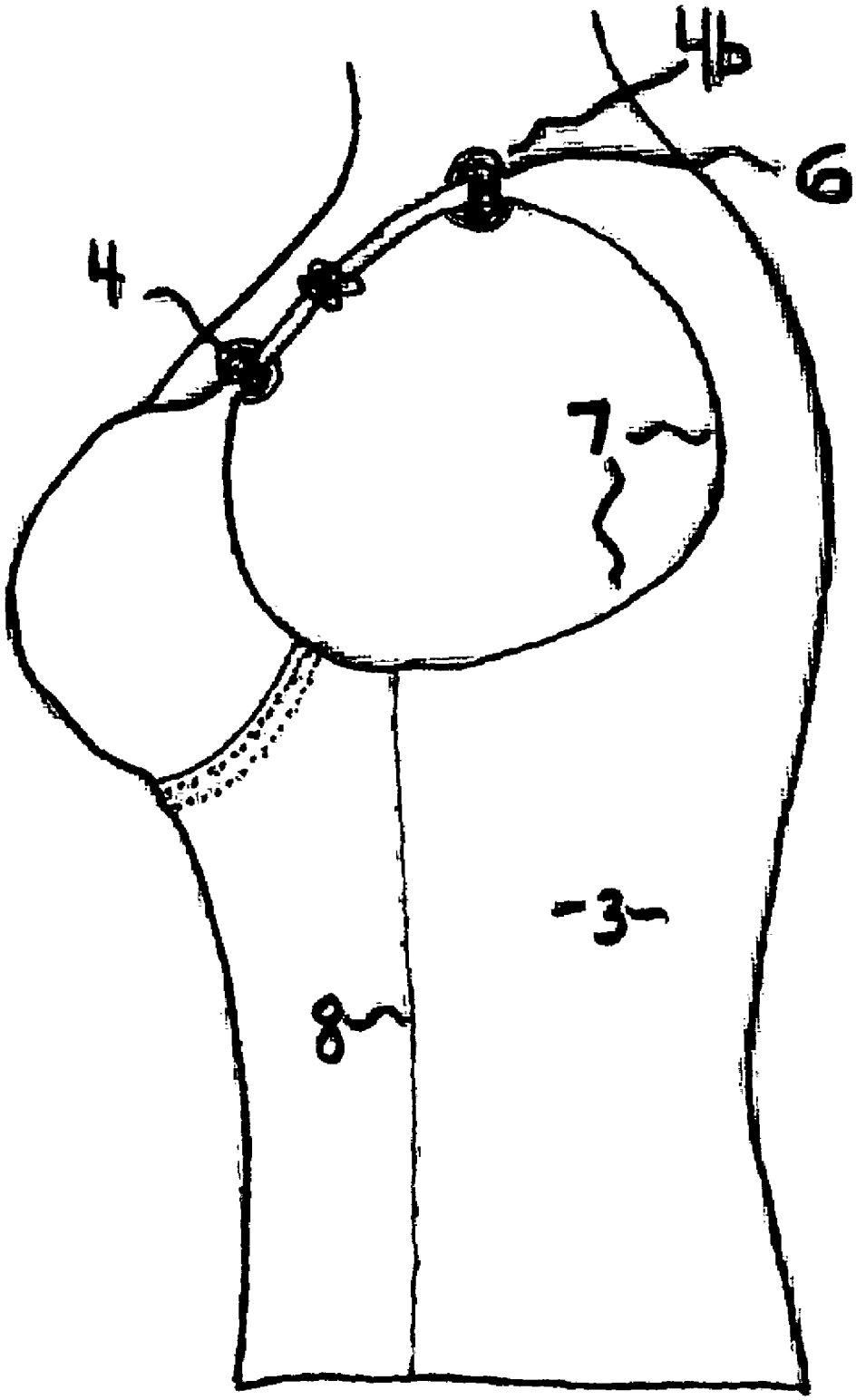
FIG. 2 is a side view of the garment as worn on a body of a woman.
Figure 3:
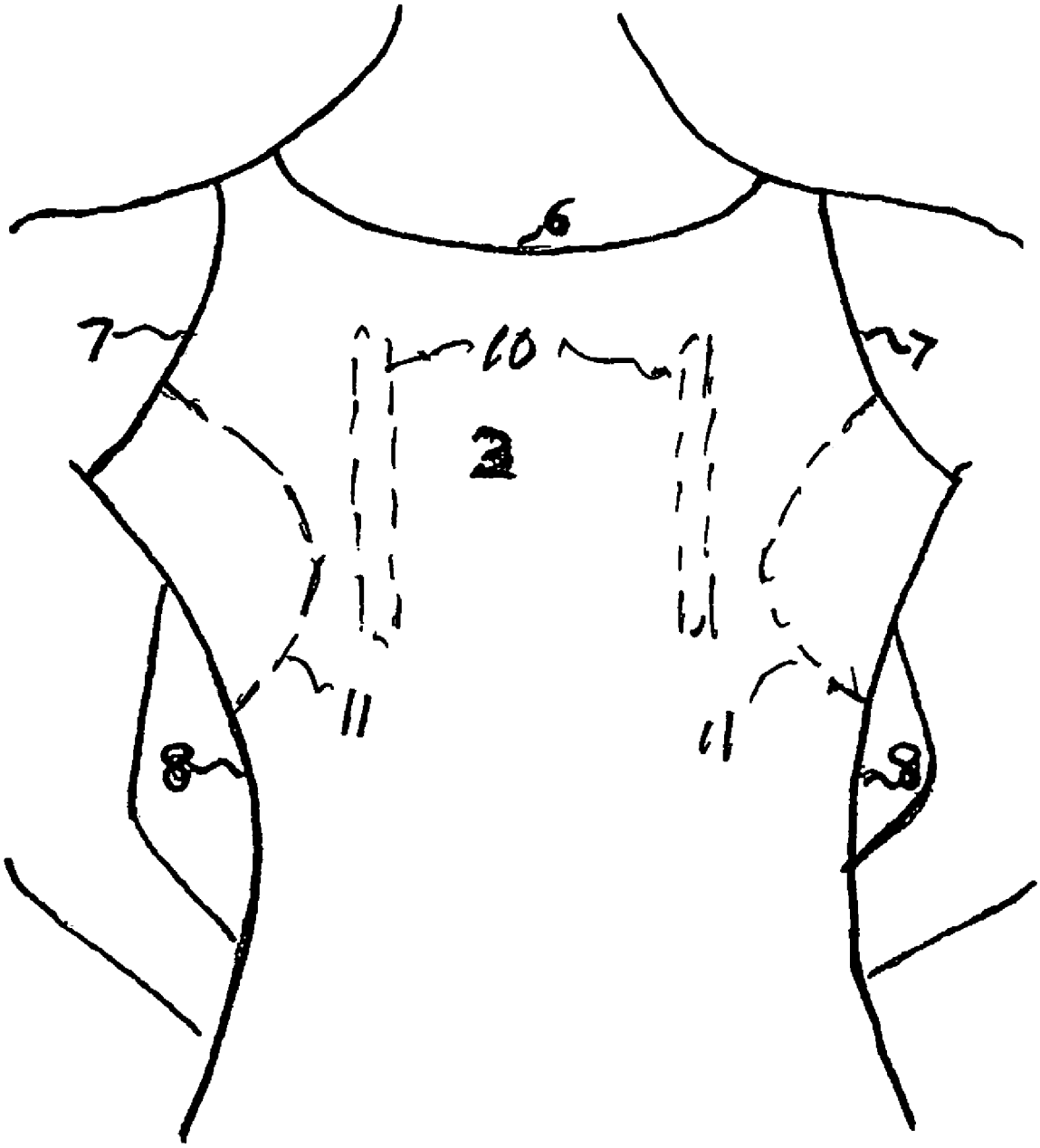
FIG. 3 is a back view of the garment.

As shown in FIG. 1, the garment of the present invention includes a form fitting bodice 1 being cut generally on the lines of a body shaper and made of a stretch quality fabric having an integrated full support bra 2 having individual bra cups attached to the front portion of the garment at least at a bottom edge of the bra cups, for supporting and shaping the breast. The front and back bodice extends at least to the wearers waist or hip line, and preferably therebelow, for compressing and smoothing the waist, abdomen and hips of the wearer. The back portion 3 of the garment as shown in FIGS. 1 and 2 is designed in the style of a full coverage tank style top, but has extended shoulder pieces 4 extending over the shoulder and down the front of the body so as to attach to top portions on each side of the bra, as shown at 5 in FIG. 2, or to connect with front bra straps, as shown in FIG. 1. The neckline 6 on the back portion is high cut following the natural curve of the back of the neckline so as to cover the shoulder blades 10, as shown in dashed lines in FIG. 3, and the back portion is contoured around the back arm and underarm areas as shown at 7 in FIG. 2 for covering and evenly compressing and supporting the upper and lower back and the posterior auxiliary fat pads 11 which are located just behind the arm pit on the side of the upper back, as shown in dashed tines in FIG. 3. The front and back portions of the bodice are connected at two locations. That is, at the top of each side of the bra and on the side of the body at a connecting seam 8, for example. The garment which is made of a stretch quality fabric of spandex, such as LYCRA, for example, provides a comfortable fit with breast shaping and support without any back fasteners of a traditional bra, which would complicate the resultant garment and produce back bulges. The stretch quality fabric may also be a knitted stretch fabric. With this construction, the wearer will appear slimmer when wearing this garment in place of a traditional bra because the garment supports the breasts and creates a seamless smooth line from the top of the wearers torso to the hip line eliminating unsightly bulges in the side and back area 9 or seams which would usually show through the clothing of the wearer when wearing a prior bra or bra garment.

From the foregoing description, those skilled in the art will appreciate that the present invention is directed to a versatile garment construction providing comfortable support for, as well as natural-looking contouring of the wearer's breasts while encasing the fleshy portion of the back and underarm areas of the wearer so as to avoid unsightly bulges. The garment is free of detachable fasteners thereby permitting, one-step dressing and enables slipping on over the head or stepped into and pulled up without any closures or fasteners. The garment avoids strap slippage off the shoulder while providing abdominal compression and waist shaping and seamless lines with a slim back view, posture support and superior comfort. While the form of the garment described herein constitute a preferred embodiment of the invention, it is to be understood that the invention is not limited to the described arrangement and changes may be made therein without departing from the scope of the invention which is defined in the appended claims.

The invention claimed is:

1. A woman's garment comprising: a garment body configured as a tubular garment body formed of a stretch fabric without any one of closures or fasteners to close or fasten portions of the tubular garment body to one another; the tubular garment body having additional attached shoulder straps and being configured so as to enable the tubular garment body with the additional attached shoulder straps to at least be slipped over a head of a wearer, the tubular garment body having integrated full support individual bra cups at a front portion thereof so that at least lower edges of the individual bra cups are attached to the front portion of the tubular garment body, the tubular garment body having a back portion with a neckline so that the back portion covers a substantial portion of the back of the wearer including posterior auxiliary fat pads, the back portion being contoured around the back arm and underarm areas of the wearer so that the stretch fabric enables substantially even compression and support of the upper back, the lower back and the posterior auxiliary fat pads without visible bra lines or bulges on the back and underarm area of the wearer.

2. A woman's garment according to claim 1, wherein the tubular garment body of the stretch fabric is a knitted stretch fabric.

3. A woman's garment according to claim 1, wherein the tubular garment body of the stretch fabric extends from below the bottom of the bra cups of the front portion of the tubular garment body so that the stretch fabric covers an upper abdominal portion of the wearer to provide compression to the upper abdominal portion of the wearer.

4. A woman's garment according to claim 2, wherein the tubular garment body of the stretch fabric extends to the hips of the wearer and enables compression of the upper and lower back, upper and lower abdominal area and the waist of the wearer.

5. A woman's garment according to claim 1, wherein at least the back portion of the tubular garment body of the stretch fabric is formed solely of the stretch fabric without an additional elastic band at the back portion.

6. A woman's garment according to claim 1, wherein the back portion which covers a substantial portion of the back of the wearer, including the posterior auxiliary fat pads, further covers the shoulder blades of the wearer.

* * * * *